US010845753B2

(12) United States Patent
Sato

(10) Patent No.: US 10,845,753 B2
(45) Date of Patent: Nov. 24, 2020

(54) IMAGE FORMATION APPARATUS INCLUDING COVER WITH EXPOSURE UNIT

(71) Applicant: Oki Data Corporation, Tokyo (JP)

(72) Inventor: Daichi Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/687,510

(22) Filed: Nov. 18, 2019

(65) Prior Publication Data

US 2020/0241463 A1 Jul. 30, 2020

(30) Foreign Application Priority Data

Jan. 24, 2019 (JP) ..... 2019-010499

(51) Int. Cl.
*G03G 21/16* (2006.01)
*G03G 15/04* (2006.01)

(52) U.S. Cl.
CPC ... *G03G 21/1647* (2013.01); *G03G 15/04036* (2013.01); *G03G 21/1633* (2013.01); *G03G 21/1666* (2013.01); *G03G 2215/0407* (2013.01); *G03G 2221/169* (2013.01)

(58) Field of Classification Search
CPC ..... G03G 21/1647; G03G 21/1633; G03G 21/1666; G03G 21/1671; G03G 2215/0407; G03G 21/1619; G03G 15/04036; G03G 2221/1687; G03G 2221/169
See application file for complete search history.

(56) References Cited

U.S. PATENT DOCUMENTS 8,571,443 B2 * 10/2013 Kobayashi ..... G03G 21/1633 399/125
2001/0021321 A1 * 9/2001 Kikuchi ..... H04N 1/00543 399/118
2006/0050135 A1 * 3/2006 Fukuda ..... B41J 2/447 347/138
2008/0219696 A1 * 9/2008 Itabashi ..... G03G 21/1623 399/114

(Continued)

FOREIGN PATENT DOCUMENTS

JP 2016-6485 A 1/2016

*Primary Examiner* — Walter L Lindsay, Jr.
*Assistant Examiner* — Laura Roth
(74) *Attorney, Agent, or Firm* — Metrolex IP Law Group, PLLC

(57) ABSTRACT

An image formation apparatus according to an embodiment may include: an image formation unit; an apparatus main body including therein the image formation unit; a cover rotatable about a first rotation axis to open and close the apparatus main body; an exposure unit including an exposure head; and a holding member fixed to an inner surface of the cover and holds the exposure unit. The holding member includes a first support portion at a side of the holding member closer to the first rotation axis and a second support portion at a side of the holding member farther from the first rotation axis. The first support portion supports the exposure unit to be rotatable, about a second rotation axis parallel to the first rotation axis, and the second support portion supports the exposure unit to be swingable in directions closer to and away from the inner surface of the cover.

12 Claims, 9 Drawing Sheets

(56) References Cited

U.S. PATENT DOCUMENTS

| | | | | |
|---|---|---|---|---|
| 2010/0021200 | A1* | 1/2010 | Kato | G03G 21/1647 399/111 |
| 2015/0346678 | A1* | 12/2015 | Fukuda | G03G 21/1633 399/110 |

* cited by examiner

IMAGE FORMATION APPARATUS INCLUDING COVER WITH EXPOSURE UNIT

CROSS REFERENCE TO RELATED APPLICATIONS

This application claims priority based on 35 USC 119 from prior Japanese Patent Application No. 2019-010499 filed on Jan. 24, 2019, entitled "IMAGE FORMATION APPARATUS", the entire contents of which are incorporated herein by reference.

BACKGROUND

This disclosure may relate to an electrophotographic image formation apparatus, and more particularly to an image formation apparatus in which an exposure head and an image formation unit come in contact with or separate from each other.

An image formation apparatus in a related art has an exposure head (for example, an LED (Light Emitting Diode) head) attached to a top cover that can be opened and closed with respect to an apparatus main body of the image formation apparatus. The image formation apparatus is configured such that the LED comes into contact with and separates from an image formation unit in the apparatus main body, along with the opening and closing of the top cover.

For example, a rotation axis of the top cover is provided on one side of the apparatus main body in a longitudinal direction of the LED head (that is, a main scanning direction). The LED head includes, on a surface of the LED head facing the image formation unit, a circular hole on the one side in the longitudinal direction and an elongate hole on the other side in the longitudinal direction. The image formation unit includes cylindrical bosses at positions facing the circular holes and the elongate holes of the LED head. In a state where the top cover is closed, the bosses of the image formation unit are inserted into the circular hole and the elongate hole of the LED head, respectively, to thereby position the LED head and the image formation unit with respect to each other (See Patent Document 1: Japanese Patent Laid-Open No. 2016-6485 (FIGS. 20 to 26)).

The circular hole of the LED head and one of the bosses of the image formation unit fitted in the circular hole are arranged on the side closer to the rotation axis of the top cover. Thus, the one of the bosses of the image formation unit is fitted into the circular hole of the LED head, which causes the center positions thereof to be aligned, to position the LED head with respect to the image formation unit in the main scanning direction (the longitudinal direction of the LED head) and the sub-scanning direction (a direction perpendicular to the main scanning direction, a direction parallel to a medium conveyance direction).

Note that the image formation unit includes, in the vicinity of each of the two bosses, a projection (hereinafter, may be referred to as a projected piece or a spacer) that maintains a constant distance between the LED head and a photosensitive drum of the image formation unit. Thus, when the top cover is closed, the bosses of the image formation unit are inserted into the circular hole and the elongate hole of the LED head, respectively, and the LED head comes into contact with the two spacers of the image formation unit.

Patent Document 1: Japanese Patent Laid-Open No. 2016-6485

SUMMARY

In the image formation apparatus, when the top cover is rotated in an opening direction about the rotation axis thereof, the LED head moves away from the image formation unit while rotating together with the top cover. That is, the LED head moves in a rotational trajectory about a portion (i.e., near the circular hole) of the LED head that is in contact with the spacer provided closer to the rotation axis of the top cover, so a portion (i.e., near the elongate hole) of the LED head on an opposite side from the rotation axis of the top cover firstly separates away from the image formation unit.

Thus, the elongate hole of the LED head provided on the opposite side from the rotation axis of the top cover is removed from the corresponding one of the bosses of the image formation unit first, and then the circular hole of the LED head provided on the side closer to the rotation axis of the top cover is removed from the other boss of the image formation unit.

Since the circular hole of the LED head and the boss of the image formation unit which are fitted to each other are provided on the side closer to the rotation axis of the top cover, an inclination angle of the circular hole with respect to the boss when the boss comes out of the circular hole is larger than an inclination angle of the elongate hole with respect to the boss when the boss comes out of the elongate hole provided on the opposite side from the rotation axis of the top cover. Thus, upon opening the top cover, an inner circumferential surface of the circular hole of the LED head and an outer circumferential surface of the boss of the image formation unit may interfere with each other. Therefore, the LED head may not be smoothly separated from the image formation unit.

An object of an embodiment is to propose an image formation apparatus capable of smoothly separating an exposure head from an image formation unit.

An aspect of the disclosure may be an image formation apparatus that may include: an image formation unit; an apparatus main body including therein the image formation unit; a cover rotatable about a first rotation axis to open and close with respect to the apparatus main body; an exposure unit including an exposure head provided on an inner side of the cover, wherein the exposure head comes in contact with and separates away from the image formation unit upon opening and closing the cover; and a holding member that is fixed to an inner surface of the cover and holds the exposure unit in such an orientation that one side of the exposure head in a longitudinal direction of the exposure head is provided on a side closer to the first rotation axis and the other side of the exposure head in the longitudinal direction of the exposure head is provided on a side farther from the first rotation axis. The holding member includes a first support portion on a side of the holding member closer to the first rotation axis and a second support portion on a side of the holding member farther from the first rotation axis, wherein the first support portion supports the exposure unit to be rotatable, about a second rotation axis parallel to the first rotation axis, and the second support portion supports the exposure unit to be swingable within a certain range in directions closer to and away from the inner surface of the cover.

According to the above aspect, upon opening the cover, the exposure head can move away from the image formation unit while the exposure unit rotates with respect to the holding member about the second rotation axis within the certain amount in the direction in which the side of the exposure unit farther from the first rotation axis moves away from the cover. That is, the exposure head can be separated from the image formation unit in a state where an inclination angle of the exposure head with respect to the image formation unit is smaller than that in a related art, so as to prevent the exposure head and the image formation unit from being interfered with each other.

Therefore, an image formation apparatus that can smoothly separate the exposure head from the image formation unit may be realized.

DETAILED DESCRIPTION

Figure 1:
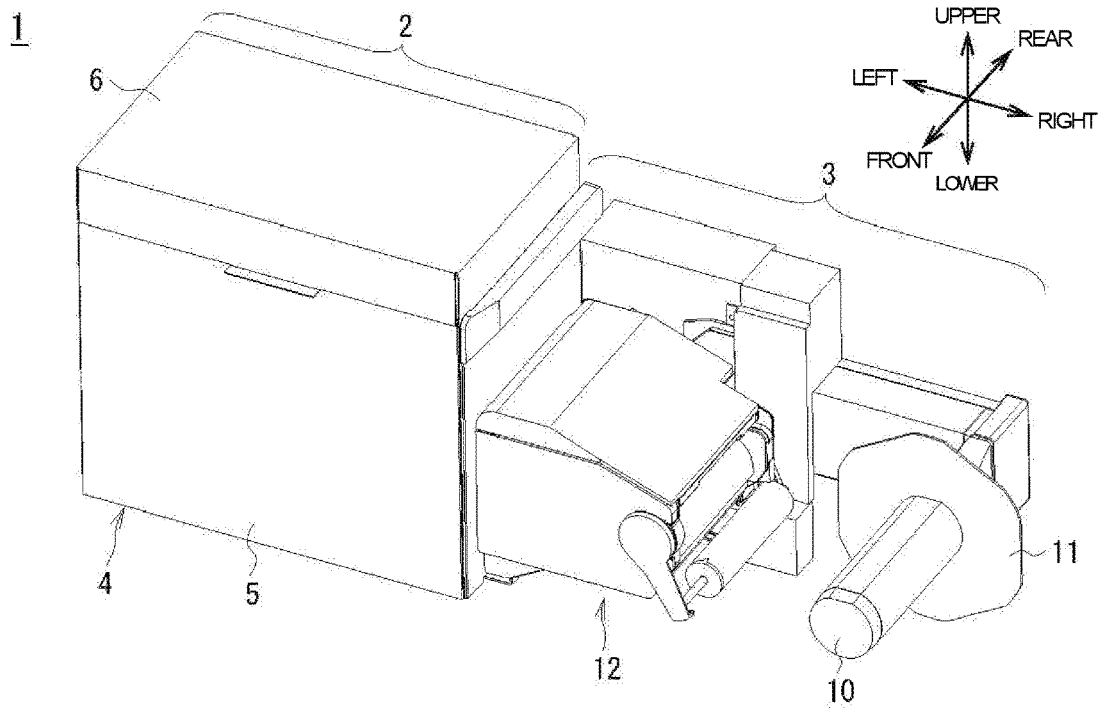
FIG. 1 is a diagram illustrating a perspective view of an appearance of an image formation apparatus in a state where a top cover is closed according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Appearance Configuration of Image Formation Apparatus

Figure 2:
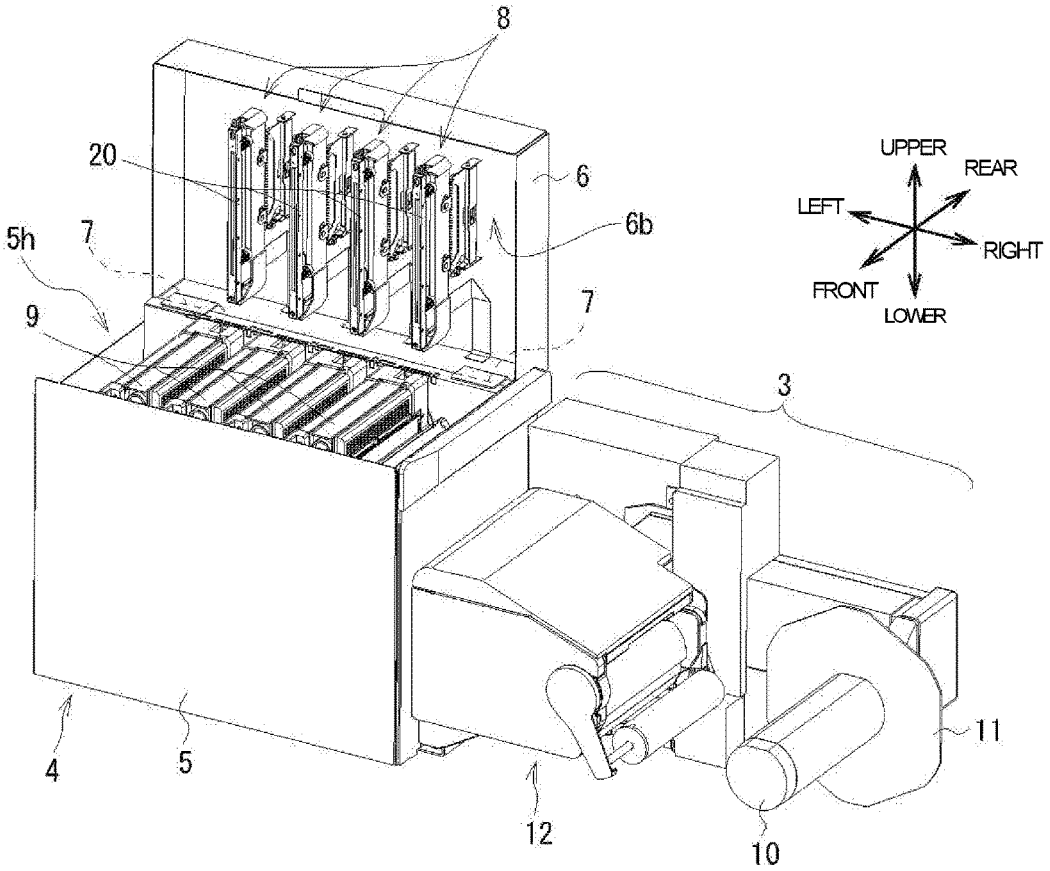
FIG. 2 is a diagram illustrating a perspective view of an appearance of the image formation apparatus in a state where a top cover is fully opened.

FIGS. 1 and 2 illustrate an appearance configuration of an image formation apparatus 1 according to one or more embodiments. The image formation apparatus 1 according to an embodiment is a printer that forms (prints) an image on a continuous long paper sheet feed from a roll paper. Note that FIG. 1 is a diagram illustrating a perspective view of an appearance of the image formation apparatus 1 in a state where a top cover 6 is closed, and FIG. 2 is a diagram illustrating a perspective view of an appearance of the image formation apparatus 1 in a state where the top cover 6 is fully opened.

As illustrated in FIGS. 1 and 2, the image formation apparatus 1 includes a printing device 2 or a printer device and a paper feeding device 3 or a medium feeding device. The printing device 2 includes an apparatus housing 4 formed in for example a rectangular parallelepiped shape. In the following description, a direction from a front surface to a rear surface of the apparatus housing 4 is referred to as a rear direction, a direction from the rear surface to the front surface of the apparatus housing 4 is referred to as a front direction, a direction from a lower side to an upper side of the apparatus housing 4 is referred to as an upward direction, a direction from the upper side to the lower side of the apparatus housing 4 is referred to as a downward direction, a direction from a right side to a left side of the apparatus housing 4 is referred to as a left direction, and a direction from the left side to the right side of the apparatus housing 4 is referred to a right direction.

The apparatus housing 4 includes a box-shaped apparatus main body 5 having an opening 5*h* on an upper surface thereof and the top cover 6 (or a lid) that covers the opening 5*h* of the opening 5*h* of the apparatus main body 5. The top cover 6 is attached to the apparatus main body 5 so as to be openable and closable by a hinge connecting a lower portion of a rear surface of the top cover 6 and an upper portion of a rear surface of the apparatus main body 5. Specifically, the top cover 6 opens and closes with respect to the apparatus main body 5 while rotating about a cover rotation axis 7 provided in the hinge. The cover rotation axis 7, serving as a first rotation axis, extends in the left-right direction in this example.

As described above, the apparatus housing 4 can be opened and closed by the top cover 6. In the state where the top cover 6 is opened, plural (for example, four) LED head assemblies 8 attached to the top cover 6 are separated away from plural (for example, four) image formation units 9 provided in the apparatus main body 5. In the state where the top cover 6 is closed, four LED head assemblies 8 attached to an inner side of the top cover 6 are in contact with the four image formation units 9 provided in the apparatus main body 5 respectively. Configurations of each LED head assembly 8 and each image formation unit 9 will be described later.

The paper feeding device 3 is attached to one side surface of the printing device 2 (for example, a right surface of the apparatus main body 5). The paper feeding device 2 includes: a roll paper insertion shaft 10 that rotatably supports a roll paper; a roll paper stopper flange 11 that regulates the position in a width direction of the roll paper supported by the paper insertion shaft 10; and a paper feed unit 12 that feeds the roll paper supported by the roll paper insertion shaft 10 to the printing device 2. The roll paper insertion shaft 10 extends in the front-rear direction of the apparatus housing 4, and the roll paper stopper flange 11 is provided on a rear end portion of the roll paper insertion shaft 10 (that is, the rear side of the image formation apparatus 1).

In the paper feeding device 3, the roll paper is set by inserting the roll paper from the front side toward the rear side of the roll paper insertion shaft 10 to make the roll paper abutting against the roll paper stopper flange 11.

A general exterior appearance of the image formation apparatus 1 is configured as described above. In the image formation apparatus 1, an image is printed by the printing device 2 on a continuous paper fed from the roll paper of the paper feeding device 3 to the printing device 2, and then the printed paper is discharged out of the printing device 2.

2. Configurations of LED Head Assembly and Image Formation Unit

Next, configurations of the LED head assembly 8 and the image formation unit 9 are described. As illustrated in FIG. 2, four of the image formation units 9 are provided in the apparatus main body 5 such that the four image formation unit 9 are adjacent to one another and arranged by side by side in the left-right direction parallel to the cover rotation axis 7 (hereinafter may be referred to as a cover rotation axis direction). The four image formation units 9 have the same configuration except for colors (for example, four colors of magenta, cyan, yellow, and black) of toner to be contained therein.

On the other hand, four LED head assemblies 8, each including the LED head 20 as an exposure head, are arranged inside of the top cover 6 so as to be spaced apart from each other in the cover rotation axis direction. The four LED head assemblies 8 have the same configuration and correspond to the four image formation units 9, respectively. Each LED head assembly 8 is provided so as to protrude from the inner surface 6*b* of the top cover 6, and holds the LED head 20 at a distal end thereof. Specifically, each LED head assembly 8 holds, at the distal end thereof, the LED head 20 formed in a rectangular bar shape along the inner surface 6*b* of the top cover 6, in such an orientation that one end of the LED head 20 in the longitudinal direction of thereof is provided on a side closer to the cover rotation axis 7 and the other end of the LED head 20 in the longitudinal direction thereof is provided on a side farther from the cover rotation axis 7. That is, the longitudinal direction of the LED head 20 is orthogonal to the cover rotation axis direction.

Note that in the image formation apparatus 1, the longitudinal direction of the LED head 20 (that is, the direction orthogonal to the cover rotation axis direction, or the front-rear direction of the image formation apparatus 1) is a main scanning direction, and an arrangement direction of the four LED heads 20 (that is, the cover rotation axis direction, or the left-right direction of the image formation apparatus 1) is a sub-scanning direction.

Figure 3:
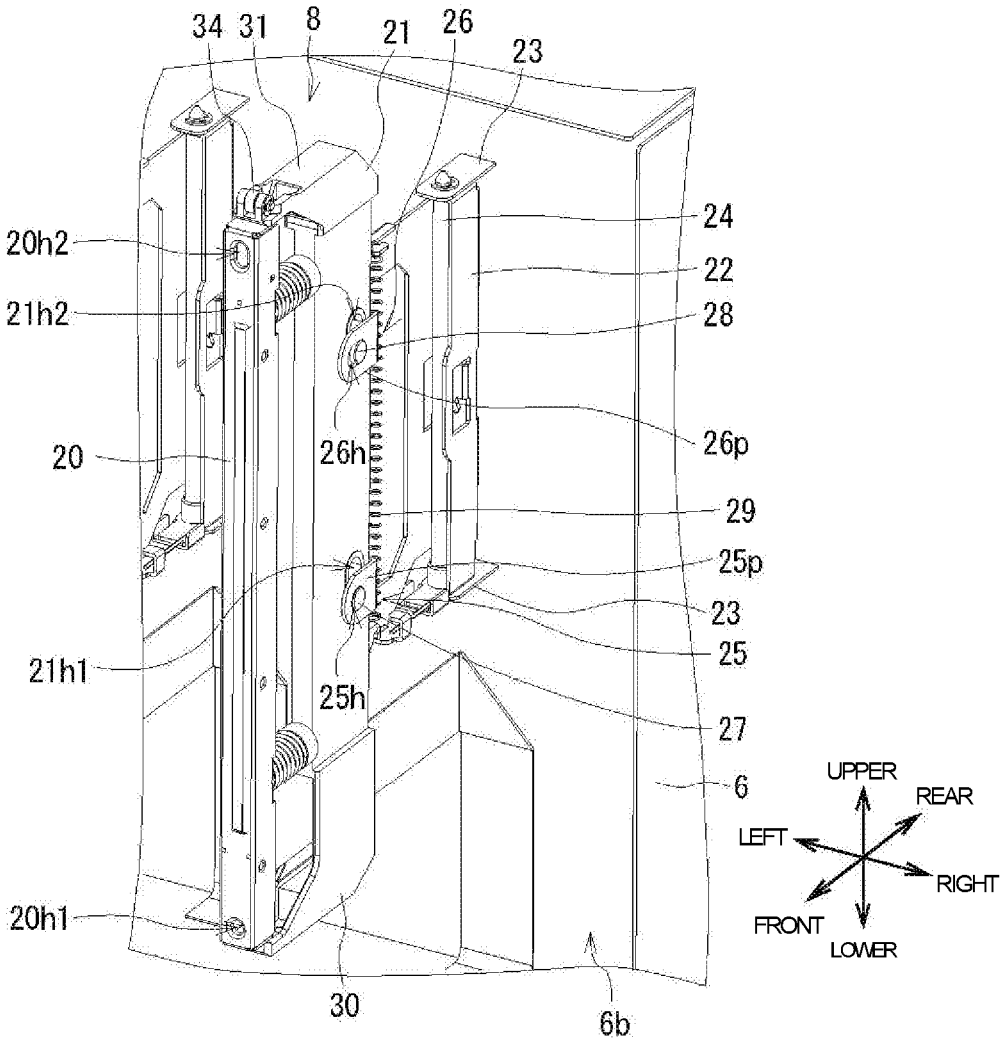
FIG. 3 is a diagram illustrating a perspective view of an appearance of a LED head assembly in a state where the top cover is fully opened.
Figure 4:
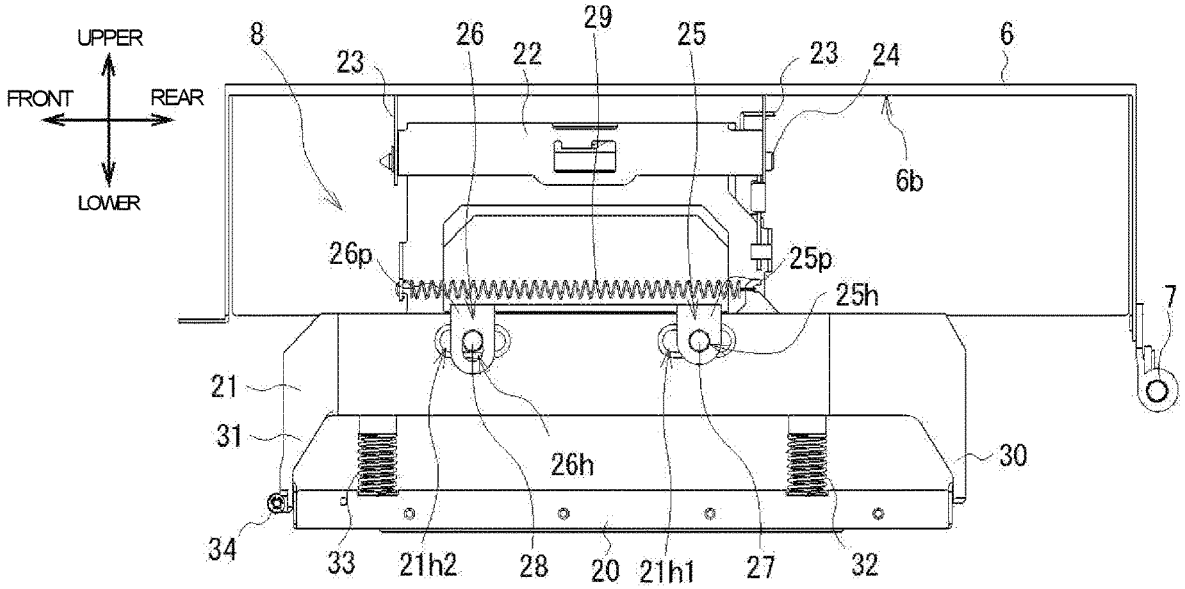
FIG. 4 is a diagram illustrating a side view of the LED head assembly in a state where the top cover is closed.

Next, a configuration of the LED head assembly 8 is described in more detail. Since the four LED head assemblies 8 have the same configuration, the configuration of only one of the four LED head assemblies 8 is described in detail below. FIGS. 3 and 4 illustrate the configuration of the LED head assembly 8. FIG. 3 is a diagram illustrating a perspective view of the LED head assembly 8 seen from the front side in the state where the top cover 6 is fully opened. FIG. 4 is a diagram illustrating a side view of the LED head assembly 8 seen from the right side in the state where the top cover 6 is closed.

As illustrated in FIGS. 3 and 4, the LED head assembly 8 is formed in a plate shape extending in a direction orthogonal to the cover rotation axis direction (that is, the vertical direction in a state illustrated in FIG. 3 and the front-rear direction in a state illustrated in FIG. 4) and is thin in the cover rotation axis direction (the left-right direction). The LED head assembly 8 includes: the LED head 20; the head holder 21 that holds the LED head 20; and the holding member 22 that is attached to the inner surface 6*b* of the top cover 6 and holds the head holder 21. That is, the LED head assembly 8 includes the holding member 22 provided on the proximal side (side closer to the inner surface 6*b* of the top cover 6), the LED head 20 provided on the distal side (side farther from the inner surface 6*b* of the top cover 6), and the head holder 21 between the holding member 22 and the LED head 20.

Two stationary plates 23 are provided on the inner surface 6*b* of the top cover 6 so as to be spaced apart from each other in the direction orthogonal to the cover rotation axis direction. The holding member 22 of the LED head assembly 8 is attached to the two stationary plates 23. A connecting shaft 24 extending in the direction orthogonal to the cover rotation axis direction extends and bridges between the two stationary plates 23, and the holding member 22 is attached to the two stationary plates 23 via the connecting shaft 24.

The holding member 22 includes two holder support portions 25 and 26 at the end thereof on a side of the head holder 21 so as to be spaced apart from each other in the direction orthogonal to the cover rotation axis direction (that is, in the longitudinal direction of the LED head assembly 8). The holder support portion 25 provided on a side closer to the cover rotation axis 7 (on a near side to the cover rotation axis 7) may be referred to as a first holder support portion 25 (or a first support portion), and the holder support portion 26 provided on a side farther from the cover rotation axis 7 (on a far side to the cover rotation axis 7) may be referred to as a second holder support portion 26 (or a second support portion).

The first holder support portion 25 includes a pair of support plates 25*p* that extend toward the head holder 21 and face each other with a gap in the cover rotation axis direction (that is, the thickness direction of the head holder 21). The support plates 25*p* are respectively provided with circular holes 25*h* facing to each other. Each of the circular holes 25*h* is a hole penetrating through the corresponding support plate 25*p*.

Similarly to the first holder support portion 25, the second holder support portion 26 includes a pair of support plates 26*p* that extend toward the head holder 21 and face each other with a gap in the cover rotation axis direction (that is, the thickness direction of the head holder 21). The support plates 26*p* are respectively provided with elongate holes 26*h* facing each other, wherein each of the elongate holes 26*h* is formed in for example an oblong shape elongated in a direction orthogonal to the inner surface 6*b* of the top cover 6. Each of the elongate holes 26*h* is a hole that penetrates through the corresponding support plate 26*p*.

On the other hand, an end portion of the head holder 21 on a side of the holding member 22 is provided with an elongate hole 21*h*1 at a position corresponding to the first holder support portion 25 and an elongate hole 21*h*2 at a position corresponding to the second holder support portion 26. The two elongate holes 21*h*1 and 21*h*2 are holes that penetrate through the head holder 21 in the thickness direction, respectively, and extend in the direction orthogonal to the cover rotation axis direction (the longitudinal direction of the LED head assembly 8).

The holding member 22 is connected to the head holder 21 in such a way that (i) the end portion of the head holder 21 on the side of the holding member 22 is sandwiched between the pair of support plates 25*p* of the first holder support portion 25 and between the pair of support plates 26*p* of the second holder support portion 26, (ii) a cylindrical connecting pin 27 serving as a second rotation axis is inserted in the direction parallel with the cover rotation axis direction into the circular hole 25*h* of the support plate 25*p* and the elongate hole 21*h*1 of the head holder 21, and (iii) a cylindrical connecting pin 28 is inserted in the direction parallel with the cover rotation axis direction into the elongate hole 26*h* of the support plate 26*p* and the elongate hole 21*h*2 of the head holder 21.

With this, the holding member 22 supports the head holder 21 by the first holder support portion 25 and the second holder support portion 26 such that the head holder 21 is swingable along the two elongate holes 21*h*1 and 21*h*2 of the head holder 21 within a certain range in the direction (the longitudinal direction of the LED head assembly 8) orthogonal to the cover rotation axis direction The first holder support portion 25 of the holding member 22 rotatably supports a portion of the head holder 21 on the side closer to the cover rotation axis 7 (on the near side to the cover rotation axis 7) about the connecting pin 27 inserted into the circular hole 25*h*, and the second holder support portion 26 of the holding member supports a portion of the head holder 21 on the side farther from the cover rotation axis 7 (on the far side from the cover rotation axis 7) to be swingable along the elongate hole 26*h* within a certain range in the direction orthogonal to the inner surface 6*b* of the top cover 6. That is, the holding member 22 supports the head holder 21 by the first holder support portion 25 and the second holder support portion 26 such that the head holder 21 is rotatable about the connecting pin 27 provided on the side closer to the cover rotation axis 7 within the certain range in such a direction that the portion of the head holder 21 on the side farther from the cover rotation axis 7 moves closer to the top cover 6 and the portion of the head holder 21 on the side closer to the cover rotation axis 7 moves away from the top cover 6.

Further, the holding member 22 supports the head holder 21 in such a manner that a tension spring 29 provided between the head holder 21 and the holding member 22 biases the head holder 21 in a direction (e.g. the upward direction in the state illustrated in FIG. 3, and the front direction in the state illustrated in FIG. 4) away from the cover rotation axis 7

The head holder 21 has a first head support portion 30 that extends toward the LED head 20 at a first end portion thereof on the side closer to the cover rotation axis 7 (on the near side to the cover rotation axis 7), and a second head support portion 31 that extends toward the LED head 20 at a second end portion thereof on the side farther from the cover rotation axis 7 (on the opposite side from the cover rotation axis 7). The distance between the first head support portion 30 and the second head support portion 31 is approximately the same as the length of the LED head 20 in the longitudinal direction thereof.

Figure 5:
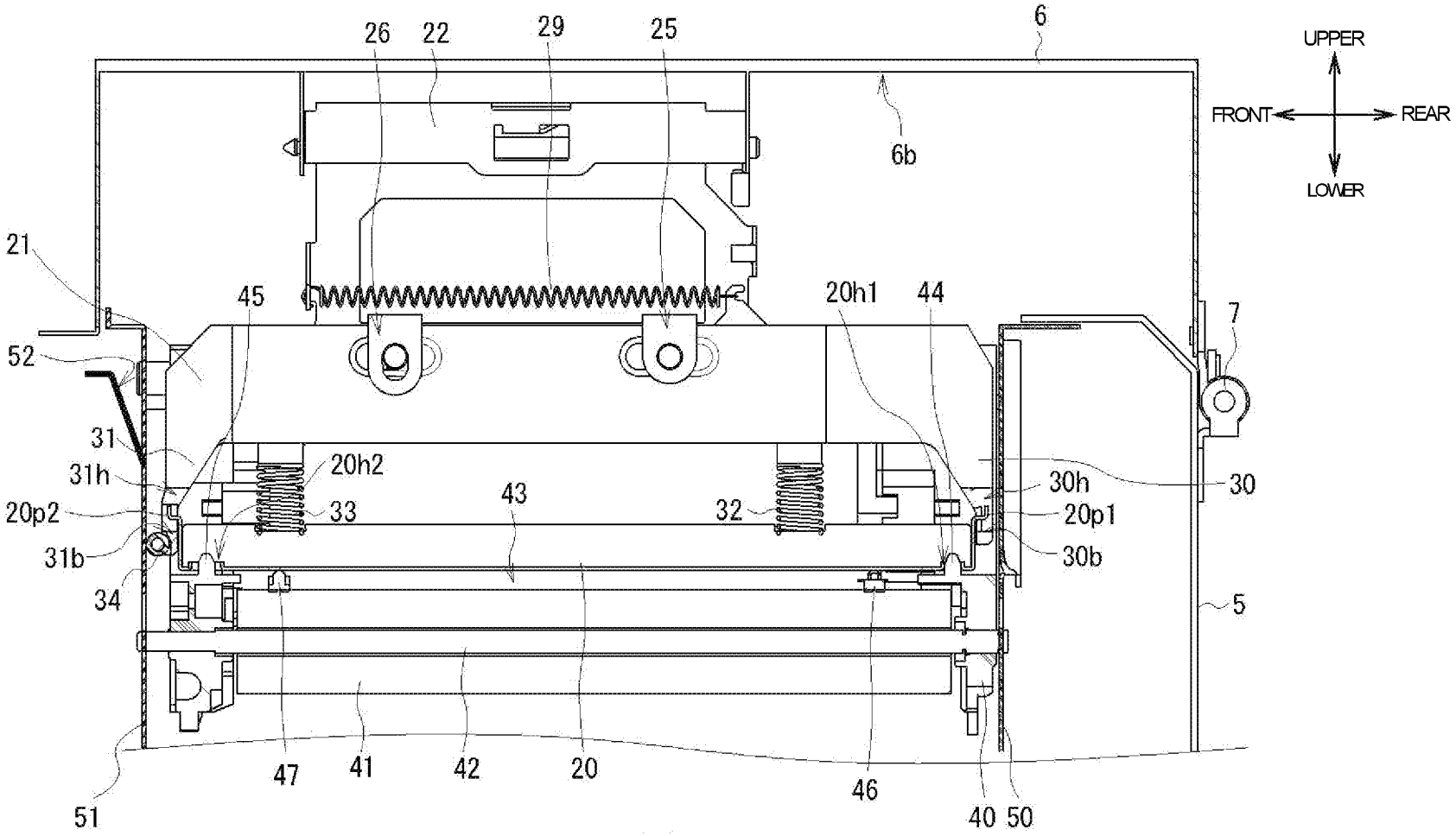
FIG. 5 is a diagram illustrating a partial cross-sectional view of the LED head assembly and the image formation unit in a state where the top cover is closed.

In addition to FIGS. 3 and 4, as illustrated in FIG. 5 which is a partial cross-sectional view of the head holder 21 and the LED head 20 seen from the right side in the state where the top cover 6 is closed, the first head support portion 30 includes, at a tip portion thereof or a distal end portion thereof, a rectangular elongate hole 30*h*. The elongate hole 30*h* penetrates through the first head support portion 30 in the direction orthogonal to the cover rotation axis direction (the longitudinal direction of the LED head assembly 8). The elongate hole 30*h* elongates in the extending direction of the first head support portion 30 (that is, the direction toward the inner surface 6*b* of the top cover 6 or the direction away from the inner surface 6*b* of the top cover 6). Similarly, the second head support portion 31 includes, at a tip portion thereof or a distal end portion thereof, a rectangular elongate hole 31*h*. The rectangular elongate hole 31*h* penetrates through the second head support portion 31 in the direction orthogonal to the cover rotation axis direction. The rectangular elongate hole 31*h* elongates in the extending direction of the second head support portion 31.

On the other hand, the LED head 20 includes a projection 20*p*1 protruding outward at a first end portion thereof on the side closer to the cover rotation axis 7 and a projection 20*p*2 protruding outward at a second end portion thereof on the side farther from the cover rotation axis 7.

The projection 20*p*1 of the LED head 20 is inserted in the elongate hole 30*h* of the first head support portion 30 and the projection 20*p*2 of the LED head 20 is inserted in the elongate hole 31*h* of the second head support portion 31. With this, the LED head 20 is supported by the head holder 21 so as to be swingable along the elongate holes 30*h* and 31*h* within the certain range in the direction toward the inner surface 6*b* of the top cover 6 and the direction away from the inner surface 6*b* of the top cover 6.

Further, the head holder 21 is provided with a first compression spring 32 that is provided in a compressed state between the LED head 20 and the head holder 21 in the vicinity of the first head support portion 30, and a second compression spring 33 that is provided in a compressed state between the LED head 20 and the head holder 21 in the vicinity of the second head support portion 31.

With these two compression springs 32 and 33, the head holder 21 supports the LED head 20 in such a manner that the projections 20*p*1 and 20*p*2 located at both end portions in the longitudinal direction of the LED head 20 are pressed against a bottom surface 30*b* at an end of the elongate hole 30*h* of the first head support portion 30 and a bottom surface 31*b* at an end of the elongate hole 31*h* of the second head support portion 31, respectively. In other words, the head holder 21 supports the LED head 20 in a state where the LED head 20 is biased away from the inner surface 6*b* of the top cover 6 by the two compression springs 32 and 33.

Hereinafter, the bottom surface 30*b* of the elongate hole 30*h* of the first head support portion 30 may be referred to as a head contact portion 30*b*, and the bottom surface 31*b* of the elongate hole 31*h* of the second head support portion 31 may be referred to as a head contact portion 31*b*. As will be described in detail later, when the top cover 6 is closed as illustrated in FIG. 5, the head contact portions 30*b* and 31*b* of the head holder 21 and the projections 20*p*1 and 20*p*2 of the LED head 20 are separated from each other.

Further, the head holder 21 includes a roller 34 rotatably attached to a tip portion or a distal end portion of the second head support portion 31, which is provided on the side (front side) farther from the cover rotation axis 7.

Further, as illustrated in FIG. 3, a surface (e.g. a front surface in the state illustrated in FIG. 3) of the LED head 20 that is to contact the image formation unit 9 includes: a circular hole 20*h*1 at a portion of the LED head 20 closer to the cover rotation axis 7 and an elongate hole 20*h*2 extending in the longitudinal direction of the LED head 20 at a portion of the LED head 20 further from the cover rotation axis 7. The LED head assembly 8 is configured as described above.

Figure 6:
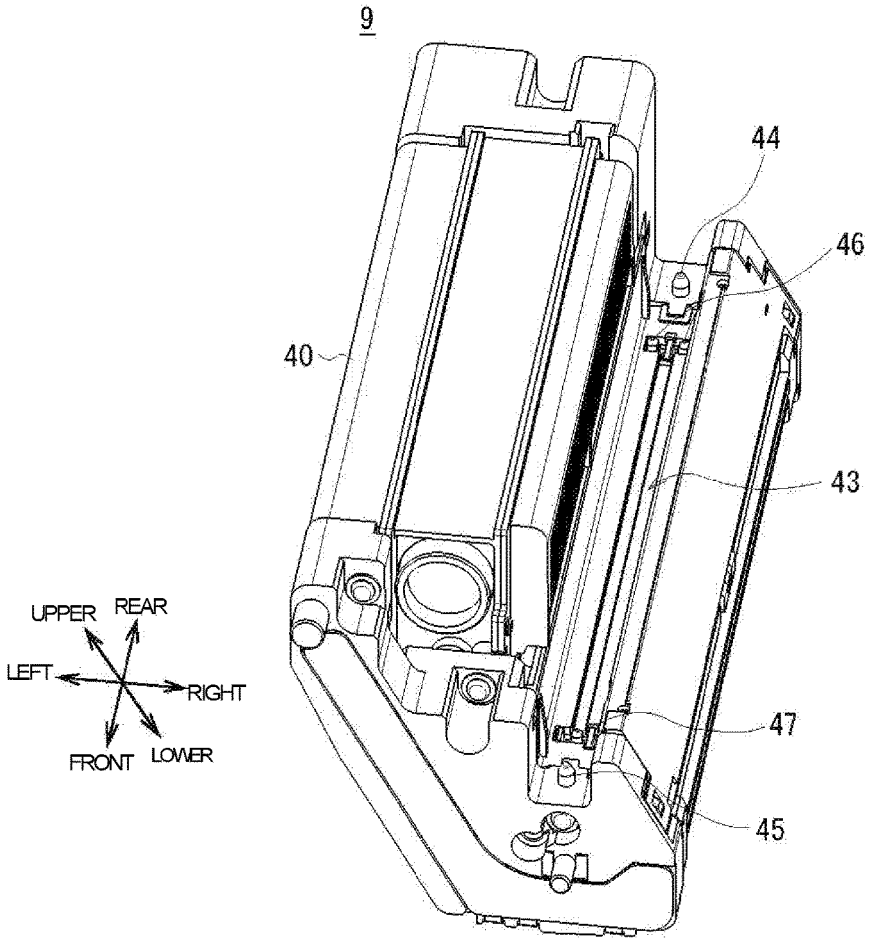
FIG. 6 is a diagram illustrating a perspective view of an appearance of an image formation unit.
Figure 7:
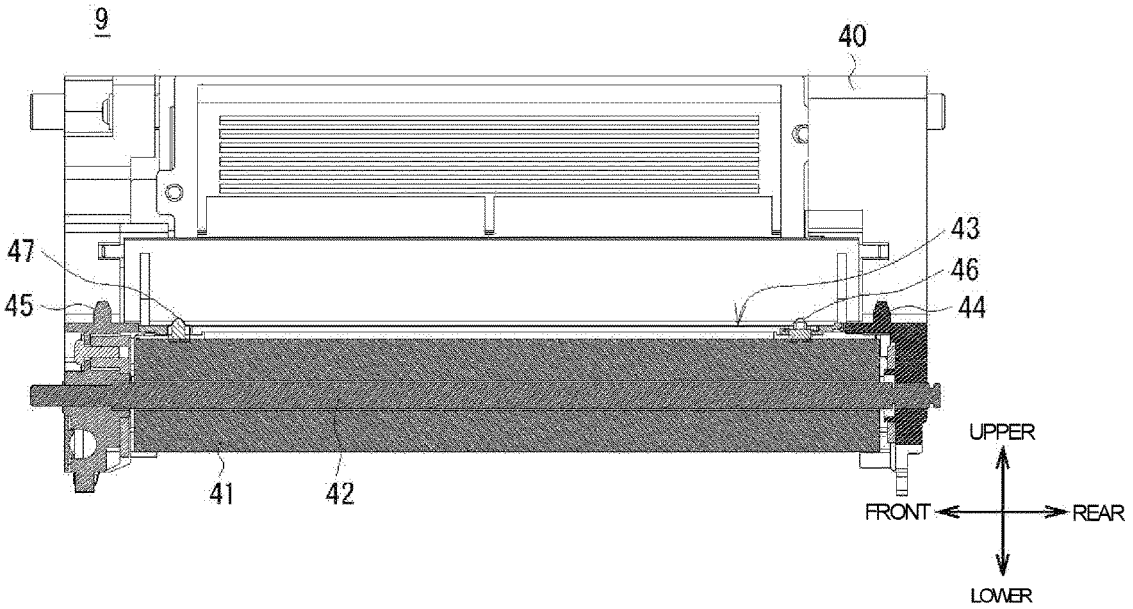
FIG. 7 is a diagram illustrating a partial cross-sectional view of the image formation unit.

Next, a configuration of the image formation unit 9 is briefly described. Since the four image formation units 9 have the same configuration, the configuration of only one of the four image formation units 9 is briefly described below. FIGS. 6 and 7 illustrates a configuration of the image formation unit 9. FIG. 6 is a diagram illustrating a perspective view of the image formation unit 9 viewed from the front side, and FIG. 7 is a diagram illustrating a partial cross-sectional view of the image formation unit 9 viewed from the right side.

As illustrated in FIGS. 6 and 7, the image formation unit 9 includes a housing 40 having a substantially box-shape, a cylindrical image drum 41 (or an image carrier) extending in the front-rear direction inside the housing 40, and an drum shaft 42 that extends in the front-rear direction, serving as a rotation axis of the image drum 41.

The housing 40 of the image formation unit 9 includes a head facing portion 43 at a position directly above the image drum 41. The head facing portion 43 of the image formation unit 9 is elongated in the front-rear direction and is opposed to the LED head 20 in the state where the top cover 6 is closed. The head facing portion 43 of the image formation unit 9 has a length in the longitudinal direction thereof that is substantially the same as the length in the longitudinal direction of the LED head 20. The head facing portion 43 of the image formation unit 9 includes a columnar boss 44 protruding therefrom at a rear end portion thereof, which is an end portion of the head facing portion 43 closer to the cover rotation axis 7 (not illustrated in FIGS. 6 and 7), and a boss 45 having the same shape as the boss 44 protruding from a front end portion thereof, which is an end portion of the head facing portion 43 farther from the cover rotation axis 7. In other words, the head facing portion 43 of the image formation unit 9 includes the first boss 44 at a position facing the circular hole **20*h*1 of the LED head 20 and the second boss 45 at a position facing the elongate hole 20*h*2 of the LED head 20**.

The first boss 44 provided on the side closer to the cover rotation axis 7 has an outer diameter slightly smaller than a diameter of the circular hole **20*h*1 of the LED head 20, and is to be fitted into the circular hole 20*h*1 of the LED head 20 when the top cover 6 is closed. The second boss 45 provided on the side farther from the cover rotation axis 7 has an outer diameter slightly smaller than a length in the short side direction of the elongate hole 20*h*2 of the LED head 20, and is to be fitted into the elongate hole 20*h*2 of the LED head 20 when the top cover 6 is closed. Each of the bosses 44 and 45 is formed with a tapered shape at a tip portion or a distal end portion thereof, and thereby bosses 44 and 45 are easily inserted into or removed from the circular hole 20*h*1 and the elongate hole 20*h*2 of the LED head 20**, respectively.

The head facing portion 43 of the image formation unit 9 is provided with first and second spacers 46 and 47 (or projected pieces) protruding in the vicinities of the first boss 44 and the second boss 45, respectively. The first spacer 46 and the second spacer 47 of the head facing portion 43 are in contact with the LED head 20 in the state where the top cover 6 is closed, so that a distance between the LED head 20 and the surface of the image drum 41 is kept constant. The image formation unit 9 is configured as described above.

As illustrated in the partial cross-sectional view of FIG. 5, the image formation unit 9 is positioned in place in the apparatus main body 5 in such a manner that one end portion and the other end portion of the drum shaft 42 extend out of the housing 40, and the one end portion of the drum shaft 42 is inserted and fitted into a groove (not shown) provided in a frame 50 located on the rear side in the apparatus main body 5 and the other end portion of the drum shaft 42 is inserted and fitted in a groove (not illustrated) provided in a frame 51 located on the front side in the apparatus main body 5.

As illustrated in FIG. 5, a distance between the first boss 44 provided closer to the cover rotation axis 7 and the spacer 47 provided farther from the cover rotation axis 7 is larger than a distance between the first boss 44 and the cover rotation axis 7.

With the above configuration, when the top cover 6 is closed as illustrated in FIG. 5, the LED head assembly 8 and the image formation unit 9 are brought close to each other. More specifically, when the top cover 6 is closed, the head facing portion 43 of the image formation unit 9 is brought close to the LED head 20 of the LED head assembly 8, the spacers 46 and 47 of the head facing portion 43 of the image formation unit 9 comes in contact with the LED head 20, and the bosses 44 and 45 of the head facing portion 43 of the image formation unit 9 are fitted into the circular hole **20*h*1 and the elongate hole 20*h*2 of the LED head 20, respectively. At this time, the center position of the circular hole 20*h*1 of the LED head 20 is aligned with the center position of the first boss 44 of the image formation unit 9 so that the LED head 20 is positioned in place with respect to the image formation unit 9 in the main scanning direction (the longitudinal direction of the LED head 20) and in the sub-scanning direction (the cover rotation axis direction or the LED head 20** arrangement direction).

Note that when the top cover 6 is closed, the roller 34 provided on the front side of the head holder 21 comes into contact with a guide surface 52 provided on the front side of the apparatus main body 5, and the head holder 21 is pushed toward the cover rotation axis 7. In such a state, the LED head 20 is positioned with respect to the image formation unit 9.

In the image formation apparatus 1, the LED head 20 is positioned by means of the circular hole **20*h*1 and the first boss 44 which are provided on the side closer to the cover rotation axis 7 (that is, on the back side of the image formation apparatus 1). There are mainly three reasons for this. (I) A reference to set the roll paper (a roll paper setting reference) or a conveyance reference for the roll paper is the roll paper stopper flange 11 located on the back side of the image formation apparatus 1. (II) The top cover 6 can be opened and closed from the front side of the image formation apparatus 1, since it is easier to open and close the top cover 6 from the front side than from the rear side of the image formation apparatus 1. (III) It is easier to improve a print accuracy if a writing position reference by the LED head 20 (that is, one end in the longitudinal direction of the LED head 20**) is provided closer to the roll paper setting reference (the conveyance reference).

On the other hand, the elongate hole **20*h*2 and the second boss 45 located on the side farther from the cover rotation axis 7 are not required to have such a high accuracy to align the center positions thereof. Thus, the second boss 45 may be loosely fitted in the elongate hole 20*h*2**.

3. Internal Configuration of Printing Device

Figure 8:
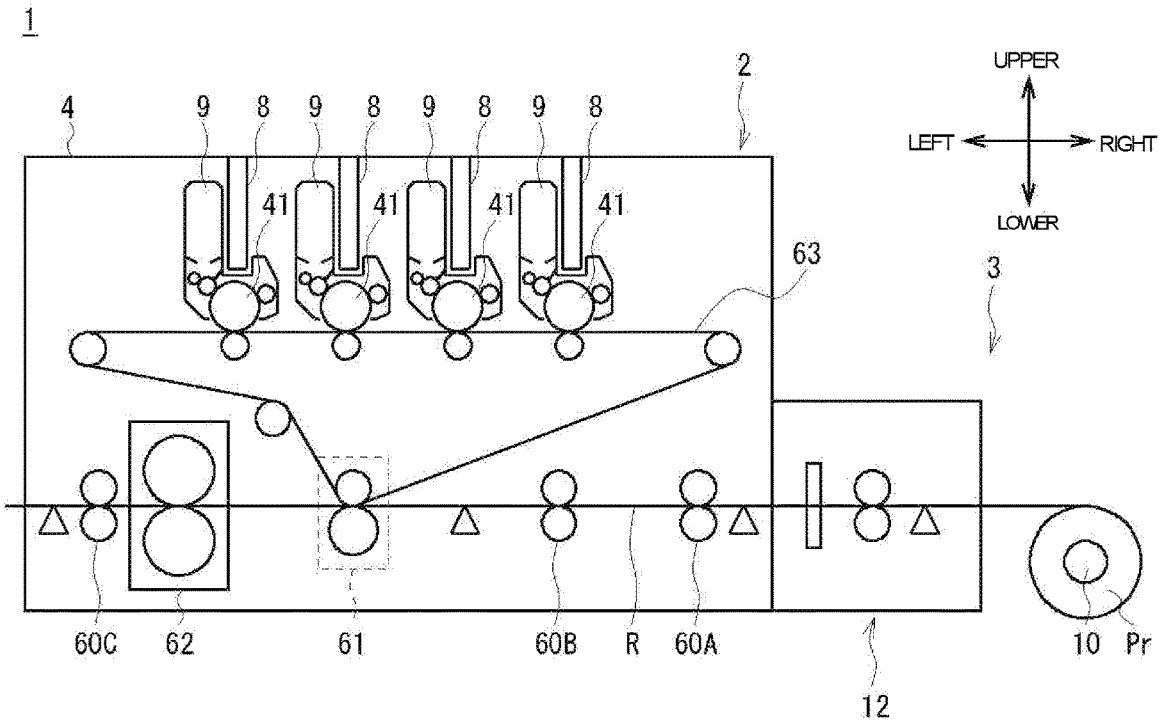
FIG. 8 is a diagram illustrating a side view of an inside of the image formation apparatus.

Next, an internal configuration of the printing device 2 is briefly described below with reference to FIG. 8. FIG. 8 is a diagram illustrating a view of an internal configuration of the printing device 2 viewed from the front side. As illustrated in FIG. 8, the printing device 2 includes, in the apparatus housing 4, a plurality of conveyance roller pairs 60A to 60C, a secondary transfer unit 61, a fixation unit 62, the four image formation units 9, the four LED head assemblies 8, and a transfer belt 63.

A conveyance path R is provided in a lower part of the apparatus housing 4. The conveyance path R extends in the left-right direction from the right surface to the left surface of the apparatus housing 4 and is connected to the paper feed unit 12 of the paper feeding device 3. In the apparatus housing 4, along the conveyance path R, the conveyance roller pair 60A, the conveyance roller pair 60B, the secondary transfer unit 61, the fixation unit 62, and the conveyance roller pair 60C are provided in that order from an upstream side (from a side closer to the paper feeding device 3) in the conveyance direction of the paper Pr. On the conveyance path R, a sensor(s) is provided for detecting the paper Pr being conveyed along the conveyance path R. The paper Pr is supplied from the paper feed unit 12 to the apparatus housing 4 and is conveyed along the conveyance path R to the secondary transfer unit 61 by the conveyance roller pairs 60A and 60B.

The four image formation units 9 are arranged side by side in the left-right direction in an upper part of the apparatus housing 4. The LED head assembly 8 is arranged above and close to the image drum 41 of each of the four image formation units 9. The transfer belt 63 is provided between the four image formation units 9 and the conveyance path R.

The LED head 20 (not illustrated in FIG. 8) of each of the LED head assemblies 8 forms an electrostatic latent image on the surface of the image drum 41 of the corresponding one of the image formation units 9. The image formation unit 9 develops the electrostatic latent image formed on the surface of the image drum 41 thereof using a developer of a corresponding color, so as to form a developer image of the corresponding color on the surface of the image drum 41. The developer image formed on each image drum 41 is transferred (primary transfer) to the transfer belt 63. The transfer belt 63 has an annular or tubular shape, and conveys the developer image transferred from each image drum 41 to the secondary transfer unit 61.

The secondary transfer unit 61 transfers (secondary transfer) the developer images conveyed by the transfer belt 63 onto the paper Pr conveyed along the conveyance path R. The paper Pr having the developer images transferred thereon is conveyed along the conveyance path R to the fixation unit 62 by the secondary transfer unit 61. The fixation unit 62 heats and presses the developer images on the paper Pr to thereby fix the developer images on the paper Pr. Then, the paper Pr having the developer images fixed thereon is conveyed by the conveyance roller pair 60C to be discharged out of the apparatus housing 4. The internal configuration of the printing device 2 is as described above.

4. Operation of LED Head Assembly Upon Opening Top Cover

Figure 9A:
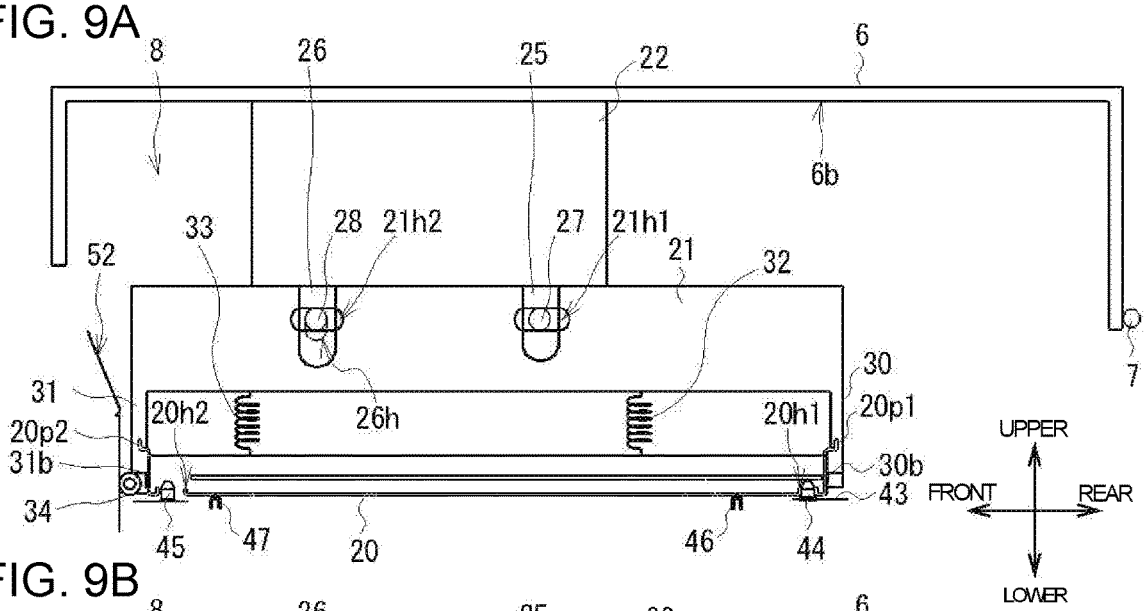
FIGS. 9A, 9B, and 9C are transition diagrams illustrating movements of the LED head assembly upon opening the top cover.

Next, an operation of the LED head assembly 8 upon opening the top cover 6 is described in detail below. Since operations of the four LED head assemblies 8 are the same, the operation of only one of the four LED head assemblies 8 is described in detail below. FIGS. 9A to 11B illustrate transition diagrams of movements of the LED head assembly 8 when opening the top cover 6. FIGS. 9A to 11B illustrate side views of the LED head assembly 8 and its peripheral portion as seen from the right side, in which parts or the like are partially omitted or simplified. FIG. 9A illustrates a state in which the top cover 6 is closed. FIGS. 9B, 9C, 10A, 10B, 10C, 11A and 11B illustrate the top cover 6 is gradually being opened in that order from the state illustrated in the FIG. 9A.

As illustrated in FIG. 9A, in the state where the top cover 6 is closed, the spacers 46 and 47 provided on the head facing portion 43 of the image formation unit 9 is in contact with the LED head 20 of the LED head assembly 8 and the bosses 44 and 45 provided on the head facing portion 43 of the image formation unit 9 are fitted into the circular hole 20*h*1 and the elongate hole 20*h*2 of the LED head 20 of the LED head assembly 8. In this state, the LED head 20 is parallel to the inner surface 6*b* of the top cover 6.

Further, in this state, the LED head assembly 8 is in contact with the spacers 46 and 47 and is pushed up in the direction in which the LED head 20 gets closer to the inner surface 6*b* of the top cover 6 (the direction in which the compression springs 32 and 33 are compressed). Thus, the head contact portions 30*b* and 31*b* of the head holder 21 and the projections 20*p*1 and 20*p*2 of the LED head 20 are spaced away from each other.

Furthermore, in this state, because the side of the head holder 21 farther from the cover rotation axis 7 is pushed up by the second compression spring 33 in the direction toward the inner surface 6*b* of the top cover 6, the connecting pin 28 provided farther from the cover rotation axis 7 is in contact with an upper end (end closer to the inner surface 6*b*) of the elongate hole 26*h* provided in the second holder support portion 26 of the holding member 22.

When the top cover 6 starts rotating about the cover rotation axis 7 from the state illustrated in FIG. 9A (that is, from the state where the top cover 6 is closed) in the clockwise direction in FIGS. 9A to 11B, the holding member 22 fixed to the inner surface 6*b* of the top cover 6 starts to rise as the top cover 6 rotates as illustrated in 9B. At this time, a portion of the holding member 22 farther from the cover rotation axis 7 rises by a distance greater than a portion of the holding member 22 closer to the cover rotation axis 7.

At this time, the head holder 21 of the LED head assembly 8 rises as the holding member 22 rises. The head holder 21 is thus pushed up, by the second compression spring 33 provided on the far side from the cover rotation axis 7 being extended, in the direction in which the side of the head holder 21 farther from the cover rotation axis 7 gets closer to the inner surface 6*b* of the top cover 6. Accordingly, the portion of the head holder 21 farther from the cover rotation axis 7 rises greatly than the portion of the head holder 21 closer to the cover rotation axis 7, similarly to the holding member 22. The connecting pin 28 remains in contact with the upper end of the elongate hole 26*h*.

Further at this time, the head holder 21 is lifted by the compression springs 32 and 33 being expanded, while the LED head 20 being pressed against the spacers 46 and 47. That is, the LED head 20 is not yet separated from the head facing portion 43 of the image formation unit 9. Further at this time, the head contact portion 31*b* provided on the side of the head holder 21 farther from the cover rotation axis 7 abuts on the projection 20*p*2 of the LED head 20, while the head contact portion 30*b* provided on the side of the head holder 21 closer to the cover rotation axis 7 is still separated from the projection 20*p*1 of the LED head 20.

Figure 9B:
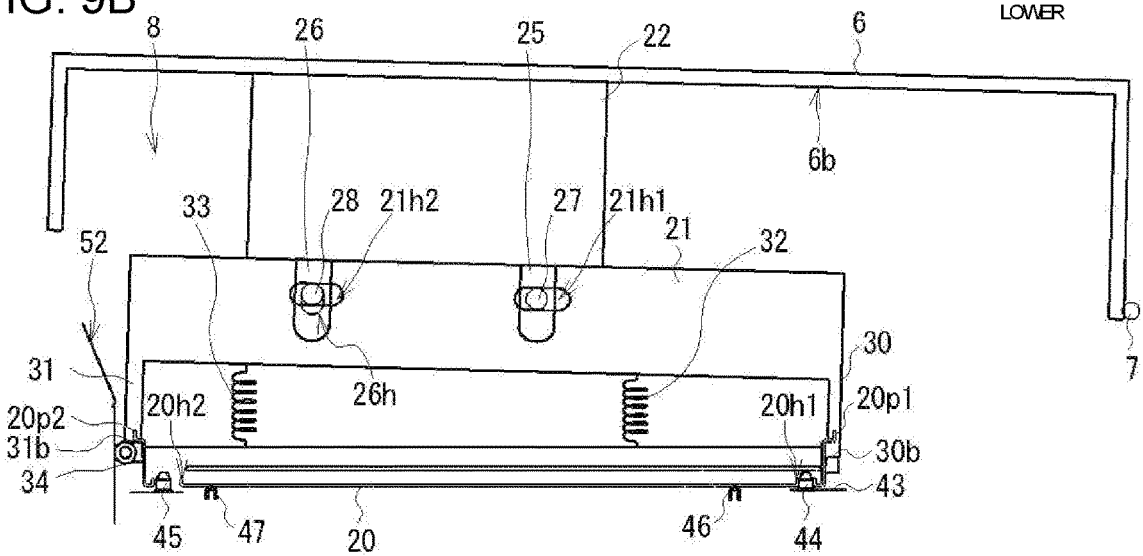

As illustrated in FIG. 9B, when the top cover 6 starts to rotate, the LED head assembly 8 starts to open, the LED head 20 remains as it is and the sides of the holding member 22 and the head holder 21 farther from the cover rotation axis 7 are lifted by a greater amount than the sides of the holding member 22 and the head holder 21 closer to the cover rotation axis 7.

Figure 9C:
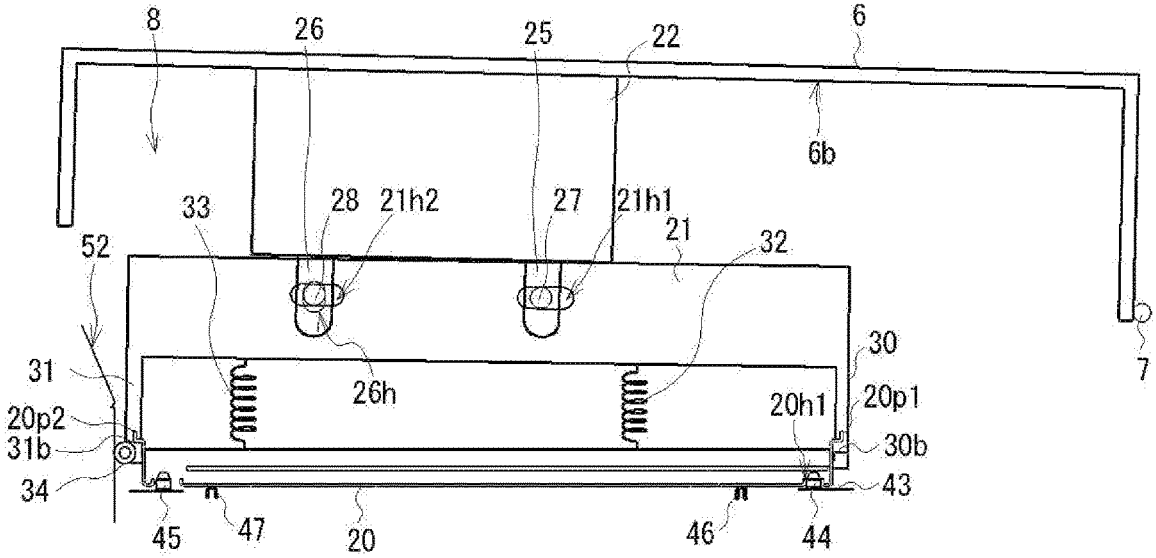

When the top cover 6 is further opened from the state illustrated in FIG. 9B, the holding member 22 of the LED head assembly 8 is further lifted as the top cover 6 rotates as illustrated in FIG. 9C. At this time, the side of the holding member 22 farther from the cover rotation axis 7 is also lifted by a greater amount than the side of the holding member 22 closer to the cover rotation axis 7.

At this state, the head contact portion 31*b* and the projection 20*p*2 of the LED head 20 are in contact with each other and thus the first compression spring 32 does not extend any further. Accordingly, the side of the head holder 21 farther from the cover rotation axis 7 does not receive the force of the second compression spring 33 that pushes up in the direction toward the inner surface 6*b*, and thus the connecting pin 28 is movable in the direction from the upper end to the lower end of the elongate hole 26*h* (that is, the direction away from the inner surface 6*b* of the top cover 6). On the other hand, the side of the head holder 21 closer to the cover rotation axis 7 is lifted as the side of the holding member 22 closer to the cover rotation axis 7 is lifted.

As a result, the side of the head holder 21 closer to the cover rotation axis 7 (the portion of the head holder 21 on the near side to the cover rotation axis 7) is lifted up, while the side of the head holder 21 farther from the cover rotation axis 7 (the portion of the head holder 21 on the far side from the cover rotation axis 7) rotates with respect to the ascending holding member 22 about the connecting pin 27 provided closer to the cover rotation axis 7 in the direction away from the inner surface 6*b* of the top cover 6. That is, the side of the head holder 21 farther from the cover rotation axis 7 is not lifted and thus moves away from the inner surface 6*b* of the top cover 6, while only the side of the head holder 21 closer to the cover rotation axis 7 is lifted up. Therefore, a rotation angle (that is, an inclination) of the head holder 21 with respect to the head facing portion 43 of the image formation unit 9 is smaller than that of the top cover 6.

Note that the side of the head holder 21 closer to the cover rotation axis 7 is lifted while the side of the LED head 20 closer to the cover rotation axis 7 is pressed against the first spacer 46 of the image formation unit 9 due to an extension of the first compression spring 32. That is, the LED head 20 is not yet separated from the head facing portion 43 of the image formation unit 9.

In this state, the head contact portion 30*b* provided on the side closer to the cover rotation axis 7 is still separated from the projection 20*p*1 of the LED head 20, and the connecting pin 28 is separated from the upper end of the elongate hole 26*h* but does not reach to the lower end of the elongate hole 26*h*.

In the state illustrated in FIG. 9C, when the top cover 6 is further rotated after the head contact portion 31*b* provided on the side of the head holder 21 farther from the cover rotation axis 7 comes in contact with the projection 20*p*2 of the LED head 20, the LED head 20 remains as it is and the side of the holding member 22 farther from the cover rotation axis 7 is lifted by a greater amount than the side of the holding member 22 closer to the cover rotation axis 7 while only the side of the head holder 21 closer to the cover rotation axis 7 is lifted.

Figure 10A:
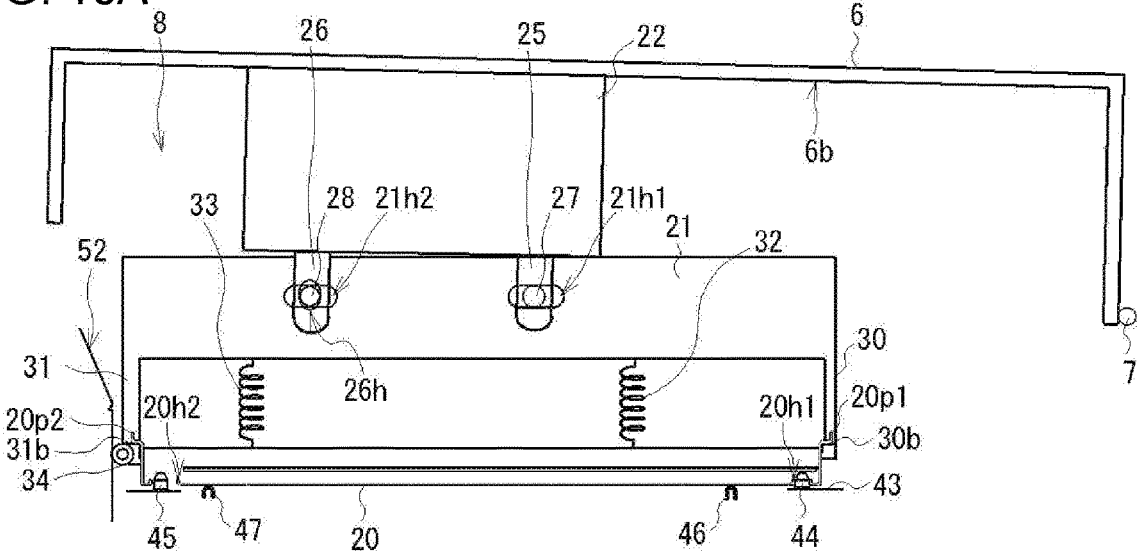
FIGS. 10A, 10B, 10C are transition diagrams illustrating movements of the LED head assembly upon opening the top cover, continued from FIG. 9C.

When the top cover 6 is further opened from the state illustrated in FIG. 9C, the holding member 22 of the LED head assembly 8 is further lifted as the top cover 6 rotates as illustrated in FIG. 10A. At this time, the side of the holding member 22 farther from the cover rotation axis 7 is also lifted than the side of the holding member 22 closer to the cover rotation axis 7.

At this time, the side of the head holder 21 farther from the cover rotation axis 7 continues to move away from the holding member 22 as being lifted, and only the side of the head holder 21 closer to the cover rotation axis 7 is lifted. At this time, the head contact portion 30*b* provided on the side of the head holder 21 closer to the cover rotation axis 7 contacts the projection 20*p*1 of the LED head 20.

That is, at this time, the head contact portions 30*b* and 31*b* of the head holder 21 are in contact with the projections 20*p*1 and 20*p*2 of the LED head 20, and the LED head 20 is not yet separated from the head facing portion 43 of the image formation unit 9. Therefore, the rotation angle of the head holder 21 with respect to the head facing portion 43 of the image formation unit 9 is still 0 degree. That is, the head holder 21 and the LED head 20 are both parallel to the head facing portion 43 of the image formation unit 9. Note that the connecting pin 28 is not yet reached to the lower end of the elongate hole 26*h*.

As illustrated in FIG. 10A, with the rotation of the top cover 6 after the head contact portion 31*b* provided on the side of the head holder 21 farther from the cover rotation axis 7 comes in contact with the projection 20*p*2 of the LED head 20, the LED head 20 remains as it is, and the side of the holding member 22 farther from the cover rotation axis 7 is lifted by a greater amount than the side of the holding member 22 closer to the cover rotation axis 7 and only the side of the head holder closer to the cover rotation axis 7 is lifted, which causes the head contact portion 30*b* provided on the side of head holder 21 closer to the cover rotation axis 7 to come in contact with the projection 20*p*1 of the LED head 20.

Figure 10B:
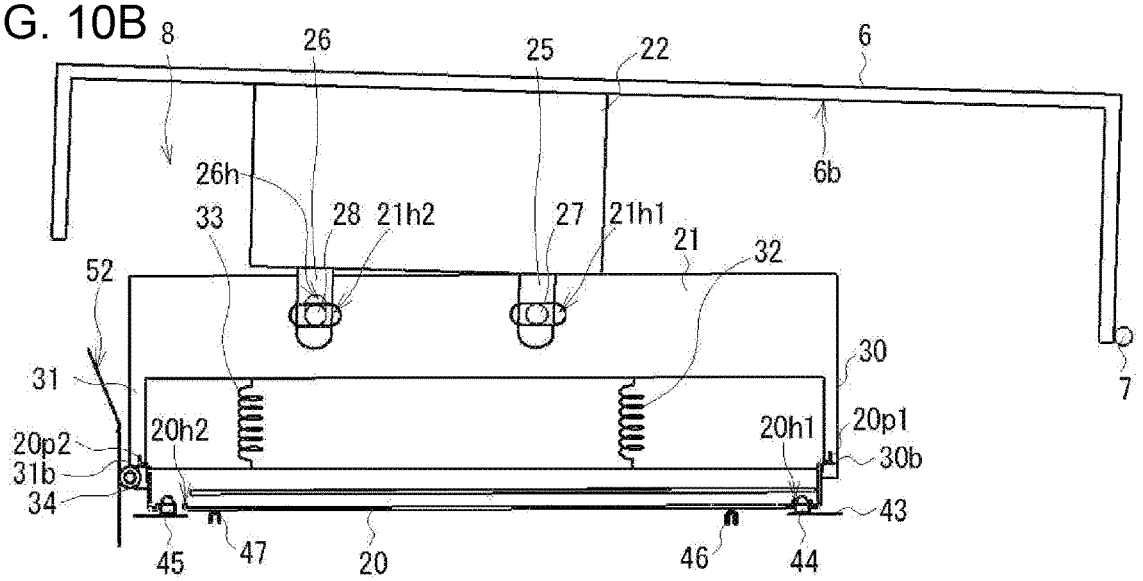

When the top cover 6 further is rotated from the state illustrated in FIG. 10A, the holding member 22 is further lifted with the rotation of the top cover 6 as illustrated in FIG. 10B. At this time, the side of the holding member 22 farther from the cover rotation axis 7 also is also lifted by a greater amount than the side of the holding member 22 closer to the cover rotation axis 7.

Until the connecting pin 28 reaches the lower end of the elongate hole 26*h*, the side of the head holder 21 farther from the cover rotation axis 7 is not lifted, which causes the side of the head holder 21 farther from the cover rotation axis 7 to move away from the holding member 22, and only the side of the head holder 21 closer to the cover rotation axis 7 is lifted. At this time, since the projection 20*p*1 provided on the side of the LED head 20 closer to the cover rotation axis 7 is in contact with the head contact portion 30*b* of the head holder 21, the side of the LED head 20 closer to the cover rotation axis 7 is lifted as the side of the head holder 21 closer to the cover rotation axis 7 is lifted.

In other words, the LED head 20 rotates, about a position where the LED head 20 is in contact with the second spacer 47 provided farther from the cover rotation axis 7, in such a direction in which the side of the LED head 20 closer to the cover rotation axis 7 moves away from the head facing portion 43 of the image formation unit 9 (that is, the counterclockwise direction in FIGS. 9A to 11B). As a result, the side of the LED head 20 closer to the cover rotation axis 7 begins to be separated away from the first spacer 46, and the circular hole 20*h*1 provided on the side closer to the cover rotation axis 7 starts to come off the first boss 44 (not yet completely removed).

As illustrated in FIG. 10B, when the top cover 6 is further rotated after the head contact portions 30*b* and 31*b* of the head holder 21 come in contact with the projections 20*p*1 and 20*p*2 of the LED head 20, the head holder 21 is rotated, around the position where the head holder 21 is in contact with the second spacer 47 provided farther from the cover rotation axis 7, in the direction in which the side of the head holder 21 closer to the cover rotation axis 7 moves away from the head facing portion 43. With this, the circular hole 20*h*1 provided on the side closer to the cover rotation axis 7 starts to come off the first boss 44 provided in the head facing portion 43.

Figure 10C:
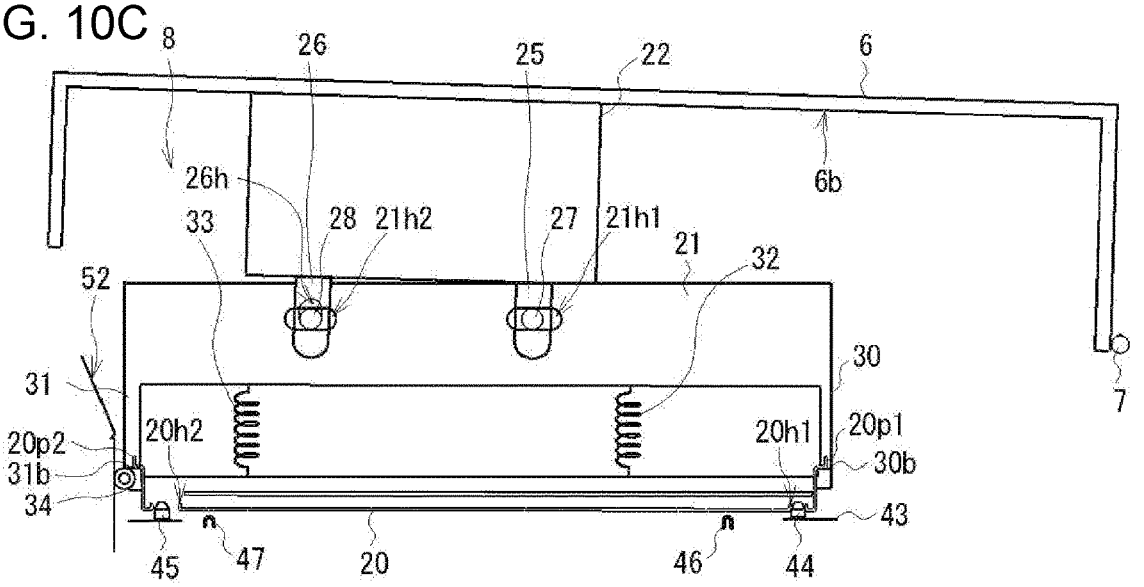

When the top cover 6 is further rotated from the state illustrated in FIG. 10B, the holding member 22 of the LED head assembly 8 is further lifted with the rotation of the top cover 6 as illustrated in FIG. 10C. At this time, the side of the holding member 22 farther from the cover rotation axis 7 is lifted by a greater amount than the side of the holding member 22 closer to the cover rotation axis 7.

At this time, the connecting pin 28 reaches the lower end of the elongate hole 26*h*. With this, the side of the head holder 21 farther from the cover rotation axis 7 is lifted by a greater amount than the side of the head holder 21 closer to the cover rotation axis 7, together with the holding member 22. Since the projections 20*p*1 and 20*p*2 are in contact with the head contact portions 30*b* and 31*b* of the head holder 21, the side of the LED head 20 farther from the cover rotation axis 7 is lifted by a greater amount than the side of the LED head 20 closer to the cover rotation axis 7, together with the head holder 21. As a result, the LED head 20 starts to move away from the second spacer 47 provided on the far side from the cover rotation axis 7, and the elongate hole 20*h*2 provided on the far side from the cover rotation axis 7 starts to come off the second boss 45.

At this time, the LED head 20 is substantially parallel to the head facing portion 43 of the image formation unit 9 and the circular hole 20*h*1 provided on the side closer to the cover rotation axis 7 has been already moved up to the tapered distal end portion of the first boss 44 of the head facing portion 43. Thus, the circular hole 20*h*1 and the first boss 44 do not interfere with each other. On the other hand, the elongate hole 20*h*2 and the second boss 45 provided on the side farther from the cover rotation axis 7 do not interfere with each other, even when the elongate hole 20*h*2 starts to come off the second boss 45 while being inclined with respect to the second boss 45, since the length of the elongate hole 20*h*2 in the longitudinal direction is longer than the diameter of the second boss 45.

As illustrated in FIG. 10C, when the cover 6 is further rotated after the circular hole 20*h*1 provided on the side of on the LED head 20 closer to the cover rotation axis 7 starts to come off the first boss 44 of the head facing portion 43, the side of the LED head 20 farther from the cover rotation axis 7 is lifted by a greater amount than the side of the LED head 20 closer to the cover rotation axis 7 as the head holder 21 is lifted. With this, the elongate hole 20*h*2 provided on the side farther from the cover rotation axis 7 also starts to come off the second boss 45 of the head facing portion 43.

Figure 11A:
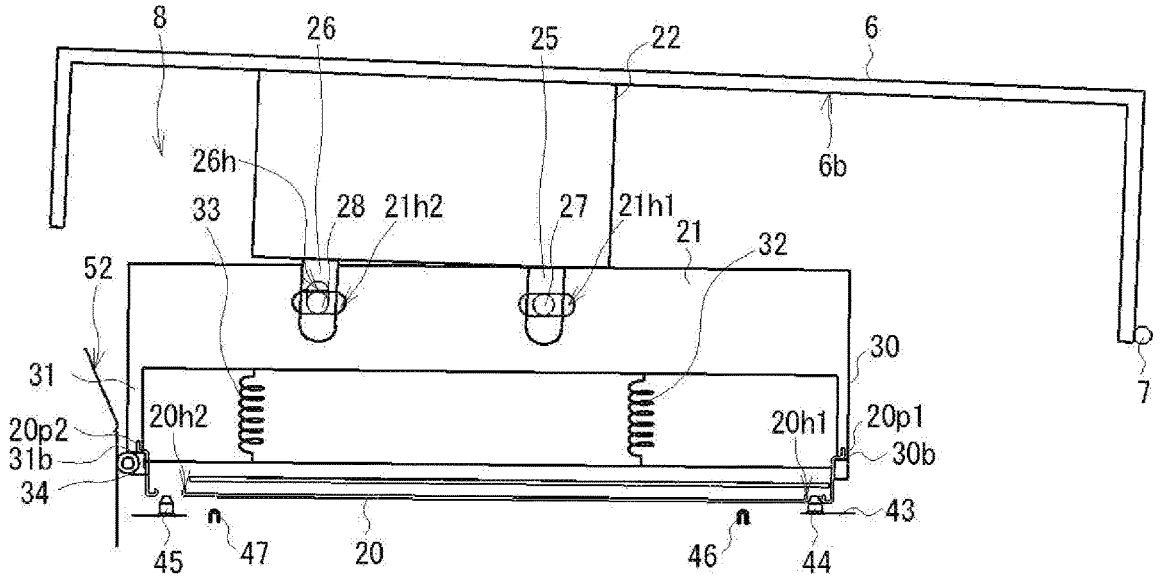
FIGS. 11A and 11B are transition diagrams illustrating movements of the LED head assembly upon opening the top cover, continued from FIG. 10C.

When the top cover 6 is further rotated from the state illustrated in FIG. 10C, the side of the LED head assembly 8 farther from the cover rotation axis 7 is generally lifted by a greater amount than the side of the LED head assembly 8 closer to the cover rotation axis 7 as the top cover 6 is rotated as illustrated in FIG. 11A.

With this, the elongate hole 20*h*2 provided on the side farther from the cover rotation axis 7 comes out from the second boss 45 first. At this time, the circular hole 20*h*1 provided on the side of the LED head 20 closer to the cover rotation axis 7 has already moved up to the tapered distal end portion of the first boss 44, and therefore does not interfere with the first boss 44.

Figure 11B:
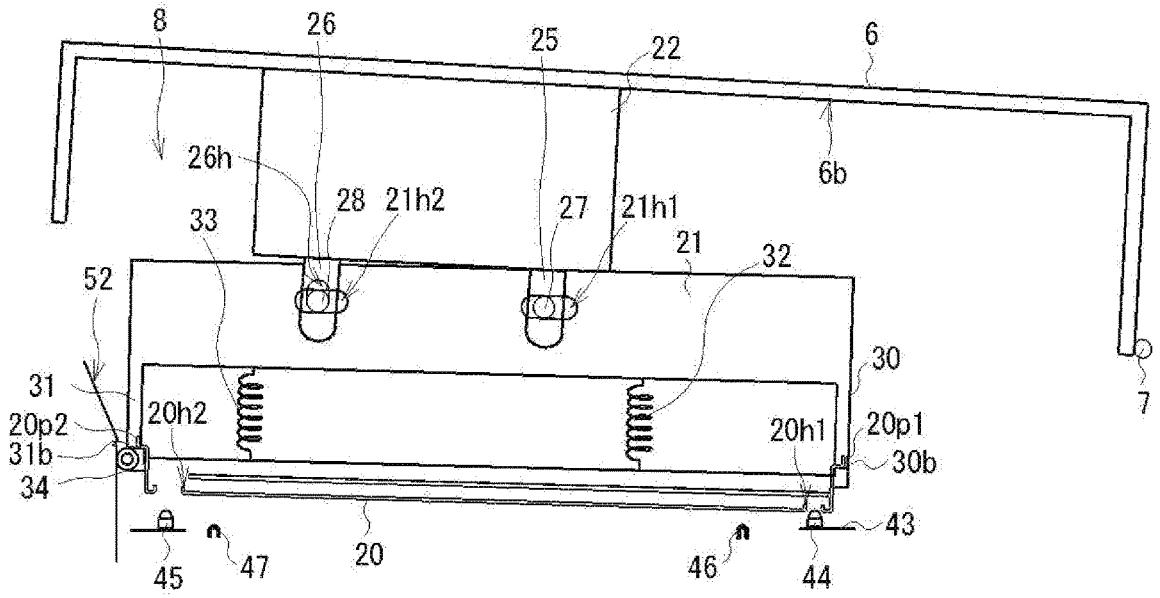

When the top cover 6 further rotates from the state illustrated in FIG. 11A, the side of the LED head assembly 8 farther from the cover rotation axis 7 is generally lifted by a greater amount than the side of the LED head assembly 8 closer to the cover rotation axis 7 as the top cover 6 is rotated as illustrated in FIG. 11B. With this, the circular hole 20*h*1 provided on the side closer to the cover rotation axis 7 also comes out from the second boss 45. At this point, the LED head 20 is completely separated from the image formation unit 9.

Thereafter, the LED head assembly 8 moves away from the image formation unit 9 as the top cover 6 is further rotated. The LED head assembly 8 is moved upon opening the top cover 6 as described above.

5. Advantages

As described above, the image formation apparatus 1 according to one or more embodiments includes the top cover 6 that can be opened and closed with respect to the apparatus main body 5 and the LED head assembly 8 including the LED head 20 provided on the inner surface 6*b* of the top cover 6, wherein the LED head assembly 8 is configured such that the LED head 20 comes in contact with and separates from the image formation unit 9 in the apparatus main body 5 when opening and closing the top cover 6.

The image formation apparatus 1 further includes: the head holder 21 that holds the LED head 20 on the LED head assembly 8 in such an orientation that one end in the longitudinal direction of the LED head 20 is on the side closer to the cover rotation axis 7 and the other end in the longitudinal direction of the LED head 20 is on the side farther from the cover rotation axis 7; and the holding member 22 that is attached to the inner surface 6*b* of the top cover 6 and holds the head holder 21, wherein the holding member 22 includes: on the side closer to the cover rotation axis 7, the first holder support portion 25 that rotatably supports the head holder 21 about the connecting pin 27 parallel to the cover rotation axis 7; and on the side farther from the cover rotation axis 7, the second holder support portion 26 that swingably supports the head holder 21 within a certain range in the directions in which the head holder 21 moves closer to and moves away from the inner surface 6*b* of the top cover 6.

With this configuration, upon opening the top cover 6, the LED head 20 is moved away from the image formation unit 9, while the head holder 21 is rotated with respect to the holding member 22 in the direction in which the side of the head holder 21 farther from the cover rotation axis 7 moves away from the inner surface 6*b* of the top cover 6 in a certain rotation amount about the connecting pin 27 provided on the side closer to the cover rotation axis 7. That is, the image formation apparatus 1 can move the LED head 20 away from the image formation unit 9 in the state where the inclination angle of the LED head 20 with respect to the image formation unit 9 is smaller than that in a related art.

With this, when the circular hole 20*h*1 provided on the side of the LED head 20 closer to the cover rotation axis 7 comes off the first boss 44 provided on the side of the image formation unit 9 closer to the cover rotation axis 7, the inclination angle of the circular hole 20*h*1 with respect to the first boss 44 can be smaller than that in the related art. Accordingly, this can more reliably prevent the circular hole 20*h*1 and the first boss 44 from being interfered with each other. That is, the LED head 20 can be smoothly separated from the image formation unit 9.

Furthermore, in the image formation apparatus 1 according to one or more embodiments, in the process that the head holder 21 rotates about the connecting pin 27 provided on the side closer to the cover rotation axis 7 by a certain amount in the direction in which the side of the head holder 21 farther from the cover rotation axis 7 moves away from the inner surface 6*b* of the top cover 6 upon opening the top cover 6, the LED head 20 rotates, about the position in contact with the second spacer 47 provided on the side farther from the cover rotation axis 7, in the direction in which the side of the LED head 20 closer to the cover rotation axis 7 moves away from the head facing portion 43 of the image formation unit 9, so as to cause the circular hole 20*h*1 on the side closer to the cover rotation axis 7 to start to come off the first boss 44 first.

That is, when the circular hole 20*h*1 starts to come off the first boss 44, the LED head 20 rotates about the position in contact with the second spacer 47 provided farther from the circular hole 20*h*1 and the first boss 44 than the first spacer 46 is. Thus, the inclination angle of the circular hole 20*h*1 with respect to the first boss 44 when the circular hole 20*h*1 comes off the first boss 44 can be sufficiently smaller than that of the related art.

6. Modifications

6-1. Modification 1

In the above-described one or more embodiments, when the top cover 6 is opened, the LED head 20 is rotated, about the position in contact with the second spacer 47 provided on the far side from the cover rotation axis 7, in the direction in which the side of the LED head 20 closer to the cover rotation axis 7 moves away from the head facing portion 43 of the image formation unit 9, so as to cause the circular hole 20*h*1 provided on the side closer to the cover rotation axis 7 starts to come off the first boss 44 first.

However, the invention is not limited to this. For example, by changing the length of the elongate hole 26*h* into which the connecting pin 28 provided on the far side from the cover rotation axis 7 is inserted, the circular hole 20*h*1 provided on the near side to the cover rotation axis 7 and the elongate hole 20*h*2 provided on the far side from the cover rotation axis 7 may almost simultaneously start to come off the bosses 44 and 45 upon opening the top cover 6.

6-2. Modification 2

In the above-described one or more embodiments, the head holder 21 supports the LED head 20 to be swingable in the directions in which the LED head 20 moves closer to and away from the inner surface 6*b* of the top cover 6. However, the invention is not limited to this. For example, the LED head 20 may be fixed to the head holder 21 or the LED head 20 and the head holder 21 may be integrated with each other.

6-3. Modification 3

In the above-described one or more embodiments, on the near side to the cover rotation axis 7, the LED head 20 is positioned by means of the circular hole 20*h*1 and the boss 44 which are provided on the near side to the cover rotation axis 7. However, the invention is not limited to this. For example, positions of the circular holes 20*h*1 and the elongate holes 20*h*2 in the LED head 20 may be interchanged with each other, so as to position the LED head 20 by means of the circular holes 20*h*1 and the bosses 45 provided on the far side from the cover rotation axis 7. In this case, the basic operation of the LED head assembly 8 may be the same as or similar to those of the above-described one or more embodiments.

In the case where the LED head 20 is positioned by means of the circular hole 20*h*1 and the second boss 45 which are provided on the far side from the cover rotation axis 7, distances between the cover rotation axis 7 and the circular hole 20*h*1 and the second boss 45 are sufficiently long, and thus the entire image formation apparatus 1 can be downsized by shortening distances between the cover rotation axis 7 and the LED head assembly 8 and the image formation unit 9

6-4. Modification 4

In the above-described one or more embodiments, the first holder support portion 25, serving as an example of a first support portion of a holding member, includes: the support plate 25*p* provided with the circular hole 25*h*; the elongate hole 21*h*1 provided in the head holder 21; and the connecting pin 27 inserted in the elongate hole 21*h*1 and the circular hole 25*h*, so that the first holder support portion 25 supports the side of the head holder 21 closer to the cover rotation axis 7 to be rotatable about the rotation axis (the connecting pin 27) parallel to the cover rotation axis 7.

The invention is not limited to this. For example, a structure different from the supporting structure composed of the support plate 25*p*, the elongate hole 21*h*1, and the connecting pin 27 may be used to support the side of the head holder 21 closer to the cover rotation axis 7 about a rotation axis parallel to the cover rotation axis 7 by a first holder support portion 25. For example, in a modification, a first holder support portion 25 may include: a circular hole provided in the head holder 21 or the holding member 22; and a connecting pin that is inserted in the circular hole to connect the head holder 21 and the holding member 22, so that the side of the head holder 21 closer to the cover rotation axis 7 is supported to be rotatable around the rotation axis (the connecting pin) parallel to the cover rotation axis 7.

In the above-described one or more embodiments, the second holder support portion 26, serving as an example of a second support portion of a holding member, includes: the support plate 26*p* provided with the elongate hole 26*h*; the elongate hole 21*h*2 provided in the head holder 21; and the connecting pin 28 inserted in the elongate hole 21*h*2 and the elongate hole 26*h*, so that the side of the head holder 21 farther from the cover rotation axis 7 is supported to be swingable within the certain range in the directions closer to and away from the inner surface 6*b* of the top cover 6.

The invention is not limited to this. For example, a structure different from the supporting structure composed of the support plate 26*p*, the elongate hole 21*h*2, and the connecting pin 28 may be used to support the side of the head holder 21 farther from the cover rotation axis 7 to be swingable within a certain range in the directions closer to and away from the inner surface 6*b* of the top cover 6 by a second holder support portion 26. For example, in a modification, a second holder support portion 26 may include: a elongate hole provided in the head holder 21 or the holding member 22, and a connecting pin that is inserted into the elongate hole to connect the head holder 21 and the holding member 22, so that the side of the head holder 21 farther from the cover rotation axis 7 is supported to be swingable within a certain range in the directions closer to and away from the inner surface 6*b* of the top cover 6.

6-5. Modification 5

In the above-described one or more embodiments, the image formation apparatus 1 is the electrophotographic color printer that prints images on the continuous paper fed from the roll paper. However, the invention is not limited to this. In a modification, a structure of an image formation apparatus may be different from the image formation apparatus 1, as long as the image formation apparatus is configured such that an exposure head comes into contact with and separates from an image formation unit in an apparatus main body upon opening and closing a cover. For example, the invention may be applied to an image formation apparatus configured to transfer a developer image formed by an image formation unit directly to a medium, without a transfer belt. Further, the invention may be applied to a single-color image formation apparatus having one image formation unit or a color image formation apparatus having more than four image formation units. Furthermore, the invention may be applied to an image formation apparatus configured to form an image on a medium other than roll paper. Furthermore, the invention may be applied to an image formation apparatus such as an electrophotographic copying machine, facsimile machine, multifunction machine, or the like.

6-6. Modification 6

In the above-described one or more embodiments, the image formation apparatus 1 is provided with the top cover 6 as an example of a cover. However, the invention is not limited to this. For example, an image formation apparatus may be provided with a cover different from the top cover 6. Further, in the above-described one or more embodiments, the image formation apparatus 1 is provided with the head holder 21 and the LED head 20 as an example of an exposure unit. However, the invention is not limited to this. For example, an image formation apparatus may be provided with an exposure unit having a configuration different from those of the head holder 21 and the LED head 20. In a modification, an exposure unit having an exposure head having a light source different from the LED head 20 may be provided. Further, in the above-described one or more embodiments, the holding member 22 is provided in the image formation apparatus 1 as an example of a holding member that holds an exposure unit. However, the invention is not limited to this. For example, a holding member different from the holding member 22 may be provided as long as the holding member functions in the same or similar manner as the holding member 22.

In the above-described one or more embodiments, the image formation unit 9 includes the spacers 46 and 48 as examples of a first contact portion and a second contact portion that contact the LED head 20. However, the invention is not limited to this. For example, a first contact portion and a second contact portion different from the spacer 46 and the spacer 47 may be provided as long as the first contact portion and the second contact portion are to come into contact with the LED head 20. Further, in the above-described one or more embodiments, the LED head 20 is provided with the circular hole **20*h*1 as an example of a first positioning portion, and the image formation unit 9 is provided with the boss 44 as an example of a second positioning portion. However, a first positioning portion different from the circular hole 20*h*1 may be provided in the LED head 20 and a second positioning portion different from the boss 44 may be provided in the image formation unit 9, as long as the first positioning portion and the second positioning portion fit with each other. Further, in the above-described one or more embodiments, the head holder 21 is provided with the compression springs 32 and 33 as examples of a biasing member. However, the invention is not limited to this. For example, a biasing member different from the compression springs 32 and 33 may be provided in the head holder 21 as long as the biasing member functions in the same or similar manner as the springs 32 and 33**.

6-7. Modification 7

Furthermore, the invention is not limited to the above-described one or more embodiments and modifications. That is, the scope of the invention extends to an embodiment or a modification in which some or all of the above-described one or more embodiments and modifications are arbitrarily combined, and an embodiment or a modification to which some of the above-described one or more embodiments and modification are extracted.

The invention can be widely used in image formation apparatuses such as printers, copiers, facsimiles, multifunction machines, or the like.

The invention claimed is:

1. An image formation apparatus comprising:

an image formation unit;

an apparatus main body including therein the image formation unit;

a cover rotatable about a first rotation axis to open and close with respect to the apparatus main body;

an exposure unit, wherein the exposure unit comes in contact with and separates away from the image formation unit upon opening and closing the cover; and a holding member that is fixed to an inner surface of the cover and holds the exposure unit in such an orientation that one side of the exposure unit in a longitudinal direction of the exposure unit is provided on a side closer to the first rotation axis and the other side of the exposure unit in the longitudinal direction of the exposure unit is provided on a side farther from the first rotation axis, wherein the holding member includes a first support portion on a side of the holding member closer to the first rotation axis and a second support portion on a side of the holding member farther from the first rotation axis, wherein the second support portion supports the exposure unit to be swingable, about the first support portion as a fulcrum, within a certain range in directions closer to and away from the inner surface of the cover along an elongate hole that is provided in one of the exposure unit and the holding member, and that is elongated in the directions closer to and away from the inner surface of the cover.

2. The image formation apparatus according to claim 1, wherein upon opening the cover, the side of the exposure unit farther from the first rotation axis swings about the first support portion with respect to the holding member in a direction in which the side of the exposure unit farther from the first rotation axis moves away from the inner surface of the cover.

3. The image formation apparatus according to claim 2, wherein the image formation unit includes a first contact portion that is in contact with the side of the exposure unit closer to the first rotation axis and a second contact portion that is in contact with the side of the exposure unit farther from the first rotation axis in a state where the cover is closed.

4. The image formation apparatus according to claim 3, wherein the exposure unit includes, at the side closer to the first rotation axis, a first positioning portion that positions the exposure unit with respect to the image formation unit, in such a manner that the first positioning portion is fit with a second positioning portion provided in the image formation unit in the state where the cover is closed.

5. The image formation apparatus according to claim 4, wherein in a process in which the exposure unit is swung about the first support portion with respect to the holding member along the elongate hole in the direction in which the side of the exposure unit farther from the first rotation axis moves away from the inner surface of the cover, the exposure unit is rotated about a position where the exposure unit is in contact with the second contact portion and thereby the first positioning portion comes off the second positioning portion.

6. The image formation apparatus according to claim 3, wherein the exposure unit includes, at the side farther from the first rotation axis, a first positioning portion that positions the exposure unit with respect to the image formation unit in such a manner that the first positioning portion is fit with a second positioning portion provided in the image formation unit in the state the cover is closed.

7. The image formation apparatus according to claim 1, wherein the second support portion supports the exposure unit to be swingable within the certain range in the directions closer to and away from the inner surface of the cover along the elongate hole, such that a connecting pin to connect the exposure unit and the holding member is inserted in the elongate hole provided in the one of the exposure unit and the holding member.

8. The image formation apparatus according to claim 1, wherein the exposure unit includes: an exposure head; a head holder that holds the exposure head to be swingable within a certain range in the directions closer to and away from the inner surface of the cover; and a biasing member that biases the exposure head in the direction away from the inner surface of the cover, wherein the holding member holds the head holder in such an orientation in which the one side of the exposure head in the longitudinal direction of the exposure head is provided on the side closer to the first rotation axis and the other side of the exposure head in the longitudinal direction of the exposure head is provided on the side farther from the first rotation axis.

9. The image formation apparatus according to claim 1, wherein the first support portion and the second support portion support the exposure unit to be swingable within a certain range in directions closer to and away from the first rotation axis.

10. The image formation apparatus according to claim 1, wherein the first support portion supports the exposure unit to be rotatable, about a second rotation axis parallel to the first rotation axis.

11. The image formation apparatus according to claim 1, wherein the exposure unit includes: an exposure head; and a head holder that holds the exposure head.

12. An image formation apparatus comprising:

an image formation unit;

an apparatus main body including therein the image formation unit;

a cover rotatable about a first rotation axis to open and close with respect to the apparatus main body;

an exposure unit, wherein the exposure unit comes in contact with and separates away from the image formation unit upon opening and closing the cover; and a holding member that is fixed to an inner surface of the cover and holds the exposure unit in such an orientation that one side of the exposure unit in a longitudinal direction of the exposure unit is provided on a side closer to the first rotation axis and the other side of the exposure unit in the longitudinal direction of the exposure unit is provided on a side farther from the first rotation axis, wherein the holding member includes a first support portion on a side of the holding member closer to the first rotation axis and a second support portion on a side of the holding member farther from the first rotation axis, wherein the image formation unit includes a contact portion that is in contact with the side of the exposure unit farther from the first rotation axis in a state where the cover is closed, the exposure unit includes, at the side closer to the first rotation axis, a first positioning portion that positions the exposure unit with respect to the image formation unit in such a manner that the first positioning portion is fit with a second positioning portion provided in the image formation unit in the state where the cover is closed, and upon opening the cover, the exposure unit is rotated with respect to the holding member about a position where the exposure unit is in contact with the contact portion of the image formation unit and thereby the first positioning portion comes off the second positioning portion.

* * * * *